US011221023B2

(12) United States Patent
Ma et al.

(10) Patent No.: US 11,221,023 B2
(45) Date of Patent: Jan. 11, 2022

(54) FAN MODULE

(71) Applicant: CHAMP TECH OPTICAL (FOSHAN) CORPORATION, Foshan (CN)

(72) Inventors: Xiao-Guang Ma, Foshan (CN); Zheng Luo, Foshan (CN)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 29 days.

(21) Appl. No.: 16/845,347

(22) Filed: Apr. 10, 2020

(65) Prior Publication Data

US 2021/0277916 A1 Sep. 9, 2021

(30) Foreign Application Priority Data

Mar. 5, 2020 (CN) ..... 202010148736.9

(51) Int. Cl.

| | |
|---|---|
| ***F04D 19/00*** | (2006.01) |
| ***F04D 29/52*** | (2006.01) |
| ***F04D 29/60*** | (2006.01) |
| ***F04D 29/64*** | (2006.01) |

(52) U.S. Cl.

CPC ..... *F04D 29/646* (2013.01); *F04D 19/007* (2013.01); *F04D 29/522* (2013.01); *F04D 29/601* (2013.01)

(58) Field of Classification Search

CPC .... F04D 19/007; F04D 29/522; F04D 29/601; F04D 29/646

See application file for complete search history.

(56) References Cited

U.S. PATENT DOCUMENTS

| | | | | |
|---|---|---|---|---|
| 8,123,461 | B2 * | 2/2012 | Yoshida | F04D 29/601 415/68 |
| 8,932,014 | B2 * | 1/2015 | Zhao | F04D 25/0613 415/213.1 |
| 9,897,094 | B2 * | 2/2018 | Kang | F04D 29/522 |
| 2009/0022587 | A1 | 1/2009 | Yoshida et al. | |
| 2009/0246015 | A1 * | 10/2009 | Hsu | F04D 29/646 415/213.1 |

* cited by examiner

*Primary Examiner* — Audrey B. Walter
(74) *Attorney, Agent, or Firm* — ScienBiziP, P.C.

(57) ABSTRACT

A fan module includes a first fan frame and a second fan frame. A side surface of the first fan frame includes a number of latching posts and a number of positioning portions extending toward the second fan frame. A side surface of the second fan frame defines a number of latching grooves in one-to-one correspondence with the latching posts. The side surface of the second fan frame further defines a number of rotating grooves in one-to-one correspondence with the positioning portions. Engagement between the latching posts and the latching grooves restricts a tangential relative displacement between the first fan frame and the second fan frame. Engagement between the rotating grooves and the positioning portions restricts an axial displacement between the first fan frame and the second fan frame.

6 Claims, 6 Drawing Sheets

FAN MODULE

FIELD

The subject matter herein generally relates to fan frames, and more particularly to a fan module for use in an electronic device.

BACKGROUND

In some environments with high heat dissipation requirements (such as large servers), multiple fans are required. In order to connect multiple fans in series, generally a fastening structure is provided at a joint portion between adjacent fan frames to lock and connect the fan frames in series. However, such fastening structures may have problems such as instability in axial and horizontal directions of the fan frame, and installation and disassembly may be inefficient.

BRIEF DESCRIPTION OF THE DRAWINGS

Implementations of the present disclosure will now be described, by way of embodiments, with reference to the attached figures.

DETAILED DESCRIPTION

Figure 1:
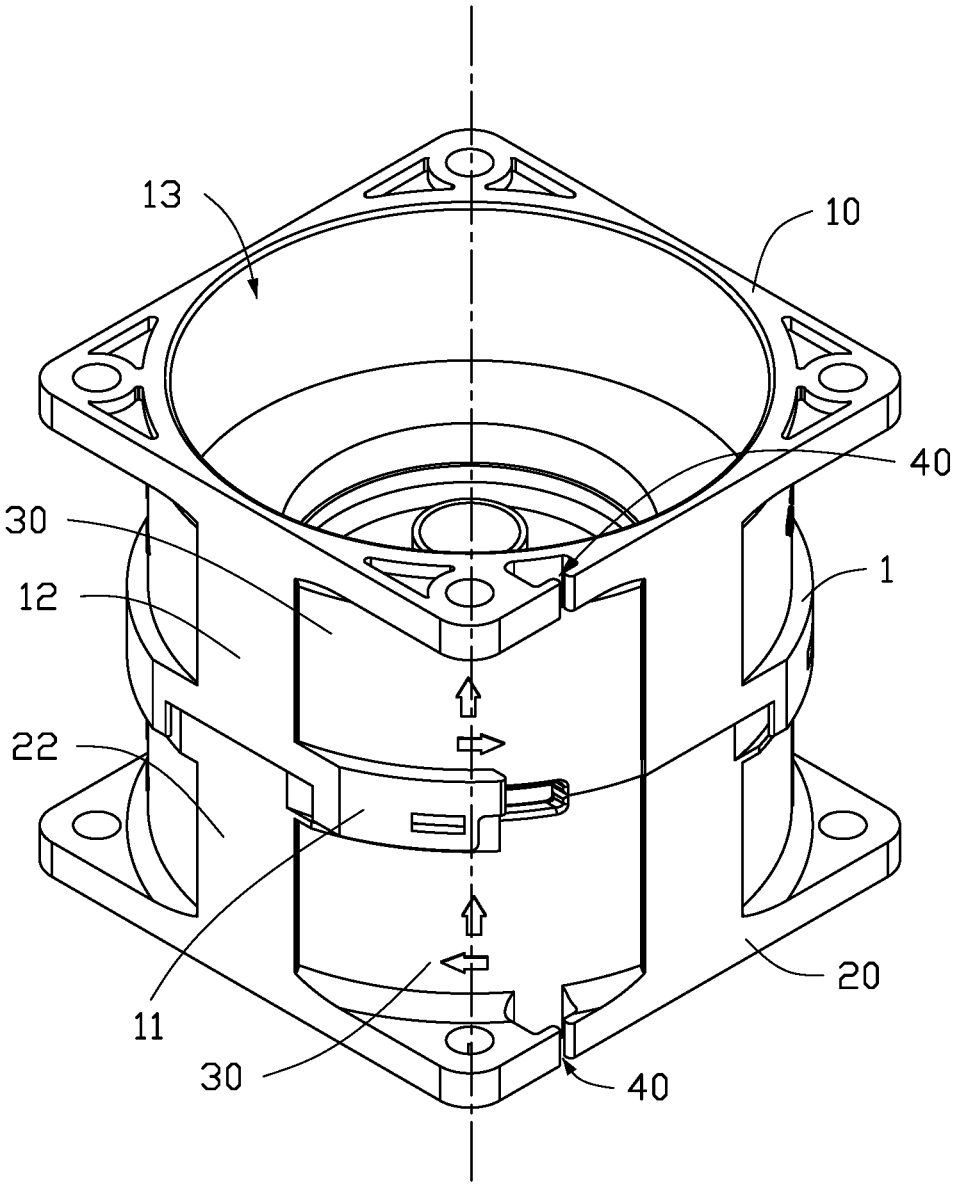
FIG. 1 is an assembled, isometric view of a first embodiment of a fan module.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIGS. 1-5 show a first embodiment of a fan module 1.

The fan module 1 includes a first fan frame 10 and a second fan frame 20. A shape of each of the first fan frame 10 and the second fan frame 20 is substantially a hollow cylinder. Each of the first fan frame 10 and the second fan frame 20 is configured to receive a fan.

Figure 2:
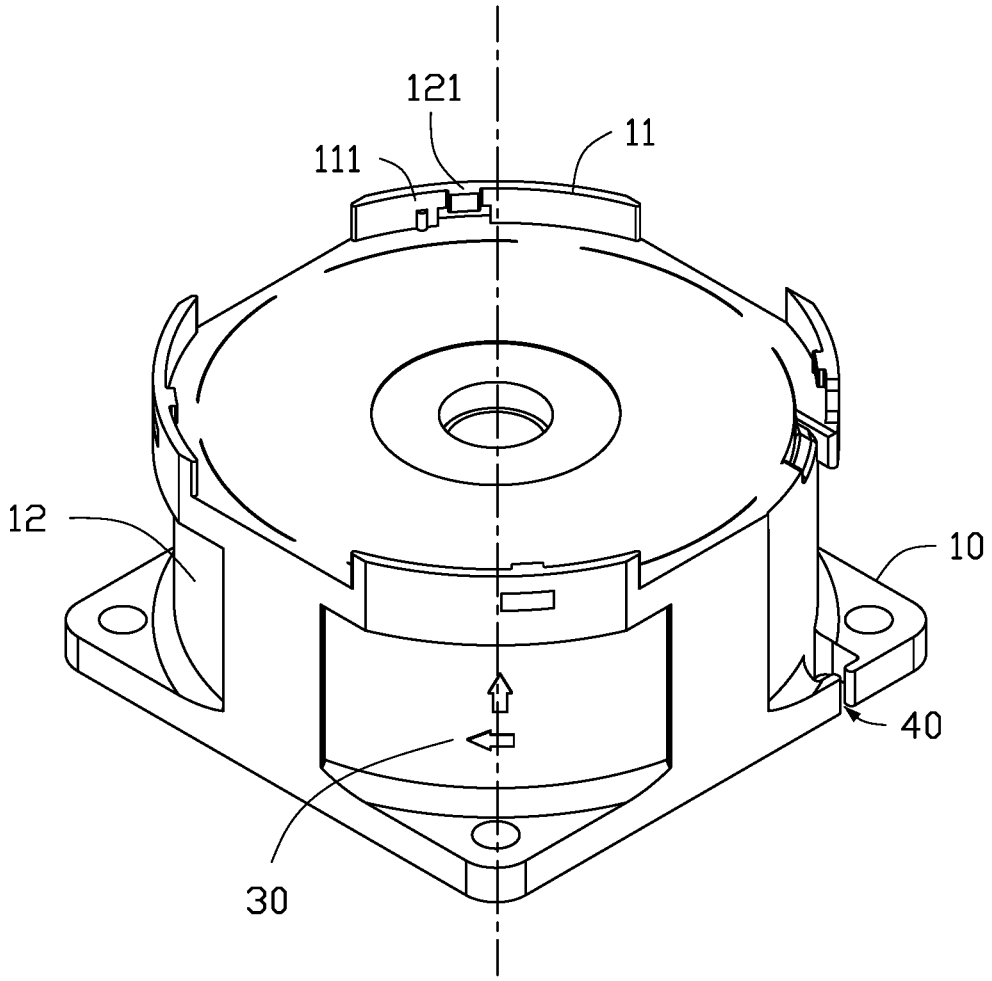
FIG. 2 is an isometric view of a first fan frame shown in FIG. 1.

Referring to FIG. 2, the first fan frame 10 includes a side surface 12. An opening 13 is defined in a side of the first fan frame 10 facing away from the second fan frame 20. The side surface 12 includes four latching members 11. Each of the four latching members 11 extends in a direction away from the opening 13 toward the second fan frame 20. Each of the four latching members 11 includes a latching post 111 and a positioning portion 121.

Figure 3:
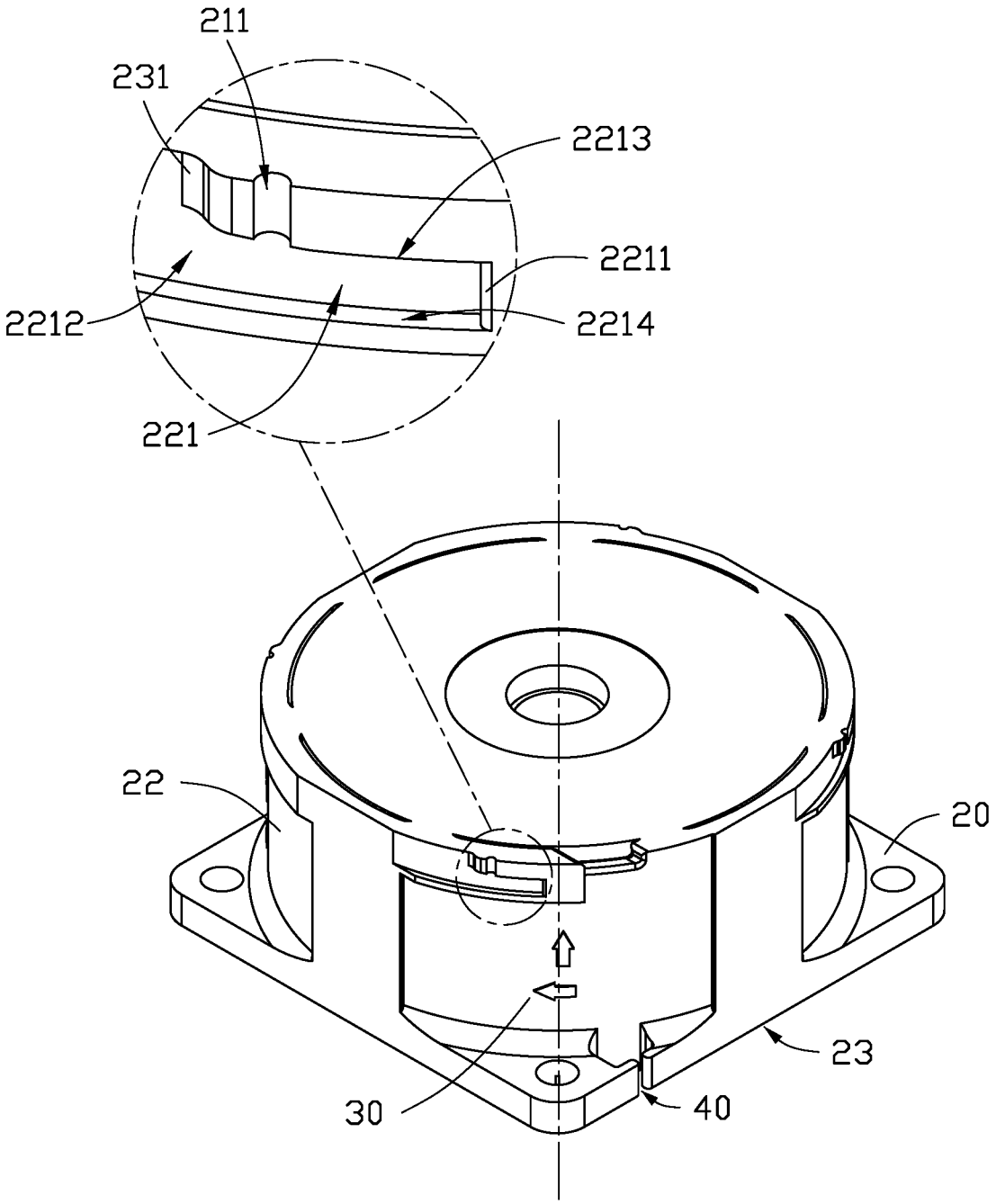
FIG. 3 is an isometric view of a second fan frame shown in FIG. 1.

Referring to FIG. 3, the second fan frame 20 includes a side surface 22. An opening 23 is defined in a side of the second fan frame 20 facing away from the first fan frame 10. An end of the side surface 22 away from the opening 23 of the second fan frame 20 defines four latching grooves 211 and four rotating grooves 221. Each of the four latching grooves 211 is in communication with one corresponding rotating groove 221. Each of the four rotating grooves 221 extends in a circumferential direction along the side surface 22. Each of the four latching grooves 211 extends in a direction substantially parallel to a central axis of the second fan frame 20. Each of the four rotating grooves 221 is bound by a short wall 2213, a long wall 2214, and a side wall 2211. The short wall 2213 is opposite the long wall 2214. The side wall 2211 is substantially perpendicularly connected between the short wall 2213 and the long wall 2214. The long wall 2214 is more adjacent to the opening 23 than the short wall 2213. The side wall 2211 is substantially parallel to the central axis of the second fan frame 20. An end of the rotating groove 221 opposite the side wall 2211 defines an open end 2212. The long wall 2214 is longer than the short wall 2213.

Figure 4:
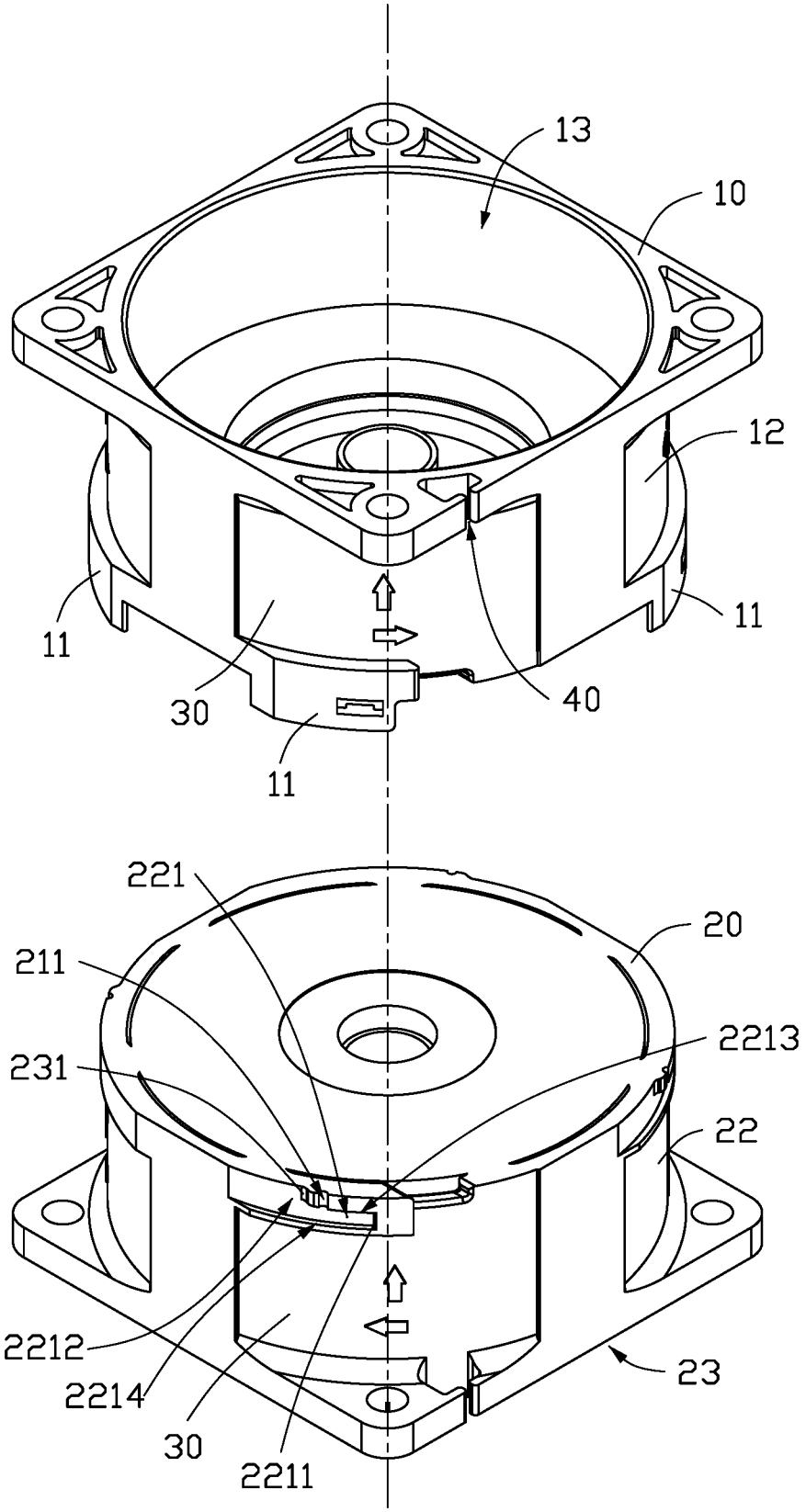
FIG. 4 is an exploded, isometric view of the fan module in FIG. 1.

Referring to FIG. 4, in a process of locking the first fan frame 10 to the second fan frame 20, a central axis of the first fan frame 10 is aligned with the central axis of the second fan frame 20, and then the first fan frame 10 is rotated such that the positioning portions 121 of the first fan frame 10 respectively enter the open ends 2212 of the rotating grooves 221 of the second fan frame 20, and each of the positioning portions 121 is moved toward the side wall 2211 until the latching post 111 is received in the latching groove 211. At this time, the positioning portion 121 abuts against the side wall 2211 of the rotating groove 221, and the two fan frames cannot continue to rotate, thereby preventing a user from rotating the fan frames in the wrong direction during disassembly and damage to the latching member 11. Engagement between the latching post 111 and the latching groove 211 restricts a tangential relative displacement between the first fan frame 10 and the second fan frame 20, and the short wall 2213 and the long wall 2214 of the rotating groove 221 restrict an axial displacement of the positioning portion 121.

In a process of unlocking the first fan frame 10 from the second fan frame 20, the first fan frame 10 is rotated such that latching post 111 leaves the latching groove 211 and the positioning portion 121 moves away from the side wall 2211 toward the open end 2212, until the first fan frame 10 and the second fan frame 20 are separated from each other.

In one embodiment, a sloped surface 231 is located adjacent to the latching groove 211 on a side of the latching groove 211 away from the side wall 2211. The sloped surface 231 is gradually recessed in a direction away from the latching groove 211. The latching post 111 may be half-cylindrical in shape, and the latching groove 211 is correspondingly semi-cylindrical in shape. The sloped surface 231 and the shapes of the latching post 111 and the latching groove 211 can improve a process of engaging or disengaging the latching post 111 and the latching groove 211 to improve a user experience.

In other embodiments, the number of each of the latching members 11, the latching grooves 211, the latching posts 111, the positioning portions 121, and the rotating grooves 221 is not limited to four, as long as the two fan frames are capable of locking together with no relative displacement.

In other embodiments, the side surface 12 of the first fan frame 10 and the side surface 22 of the second fan frame 20 are provided with surface markers 30, which indicate a rotation direction of assembly of the first fan frame 10 and the second fan frame 20 and a wind direction of a fan 3, so that a user can accurately and quickly assemble the fan module 1.

In one embodiment, the side of the first fan frame 10 defining the opening 13 and the side of the second fan frame 20 defining the opening 23 each define a wiring groove 40.

Figure 5:
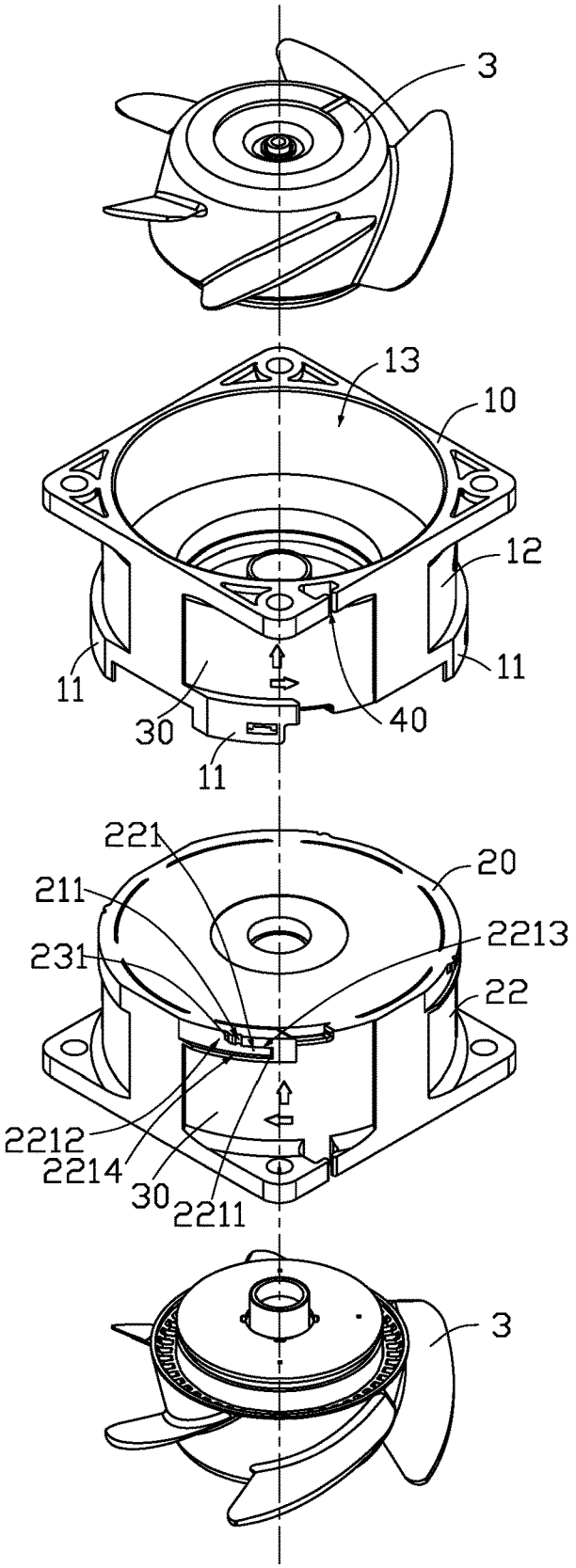
FIG. 5 is similar to FIG. 4, but showing fans received in the first fan frame and the second fan frame.

Referring to FIG. 5, two fans 3 are provided, such that one fan 3 is received in the first fan frame 10, and the other fan 3 is received in the second fan frame 20.

Figure 6:
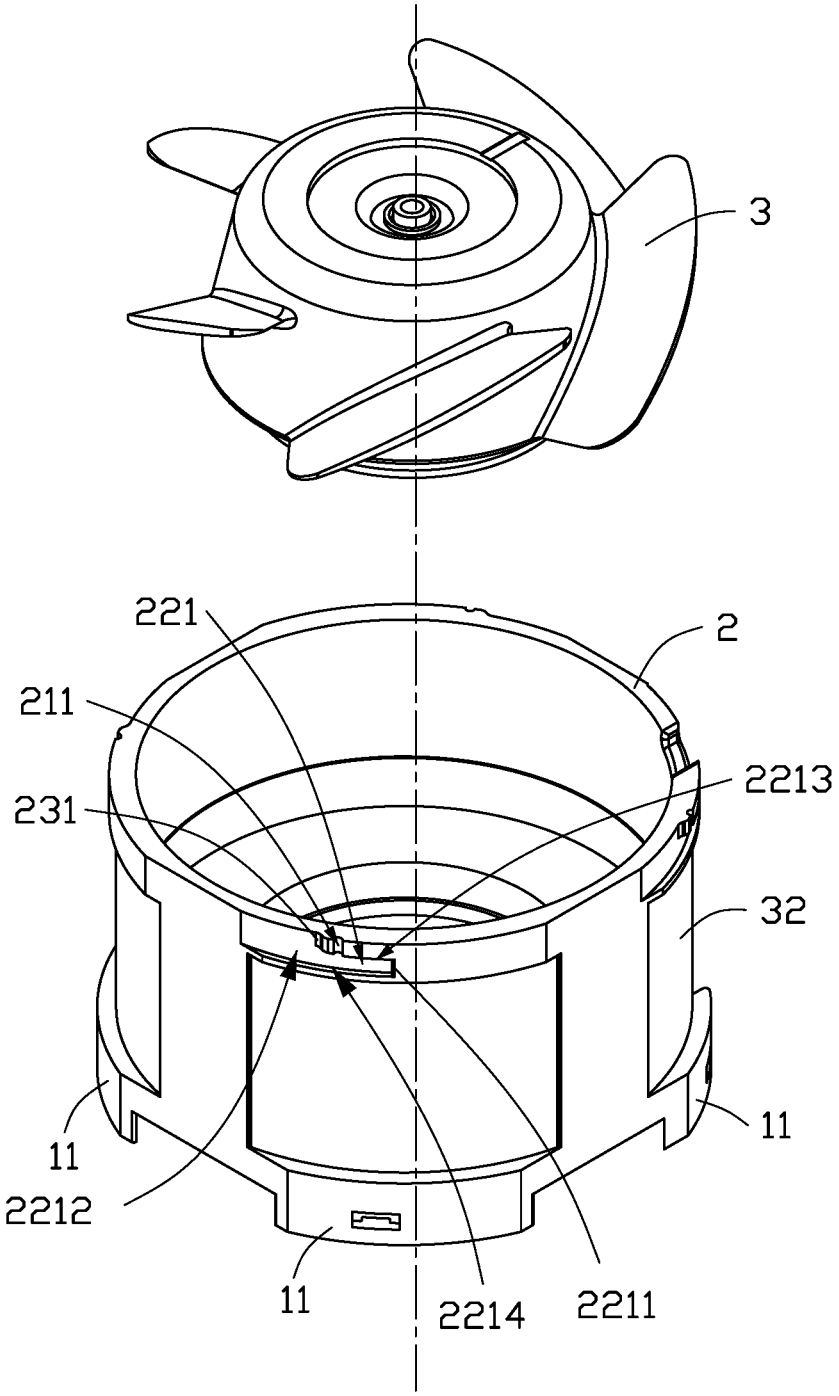
FIG. 6 is an exploded, isometric view of a second embodiment of a fan module.

FIG. 6 shows a second embodiment of a fan module 2. A shape of the fan module 2 is hollow cylindrical, and the fan 3 is received inside the fan module 2. The fan module 2 includes a side surface 32. One end of the side surface 32 is provided with a plurality of the latching members 11, a plurality of the latching posts 111, and a plurality of the positioning portions 121 as described in the first embodiment, and another end of the side surface 32 is provided with a plurality of the latching grooves 211 and a plurality of the rotating grooves 221 as described in the first embodiment. The fan module 2 can be used alone when only one fan 3 is required. A plurality of the fan modules 2 can be used in series when a plurality of the fans 3 is required.

The fan module 1, 2 is simple to install and disassemble, thereby improving efficiency. Furthermore, engagement between the latching posts 111 and the latching grooves 211 restricts a tangential relative displacement of the fan module 1, 2, and engagement between the rotating grooves 221 and the positioning portions 121 restricts an axial displacement of the fan module 1, 2.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A fan module comprising:

a circumferential side surface configured to receive a fan;

a plurality of latching members extending from a first end portion of the side surface; and a plurality of rotating grooves and a plurality of latching grooves are defined in a second end portion of the side surface; wherein:

the plurality of latching members comprises a plurality of positioning portions and a plurality of latching posts;

the plurality of rotating grooves is defined in one-to-one correspondence with the plurality of positioning portions;

the plurality of latching grooves is defined in one-to-one correspondence with the plurality of latching posts;

the plurality of rotating grooves is configured to receive a plurality of second positioning portions of a second fan module for restricting an axial displacement between the fan module and the second fan module; and the plurality of latching grooves is configured to receive a plurality of second latching posts of the second fan module for restricting a tangential relative displacement between the fan module and the second fan module.

2. The fan module of claim 1, wherein:

each of the plurality of latching grooves is in communication with a corresponding one of the plurality of rotating grooves;

each of the plurality of latching grooves extends in a direction parallel to a central axis of the fan module; and each of the plurality of rotating grooves extends in a direction perpendicular to the plurality of latching grooves.

3. The fan module of claim 2, wherein:

each of the plurality of rotating grooves is bound by a short wall, a long wall, and a side wall;

each short wall is opposite the corresponding long wall;

each side wall is coupled between the corresponding short wall and the corresponding long wall;

each side wall is parallel to the central axis of the fan module;

an end of each of the plurality of rotating grooves opposite the corresponding side wall defines an open end; and each long wall is longer than the corresponding short wall.

4. The fan module of claim 3, wherein:

when the plurality of latching posts are received in the plurality of latching grooves, each of the plurality of positioning portions abuts against the side wall of a corresponding one of the plurality of rotating grooves.

5. The fan module of claim 4, wherein:

a sloped surface is located on a side of each of the plurality of latching grooves away from the corresponding side wall; and the sloped surface is gradually recessed in a direction away from the corresponding latching groove.

6. The fan module of claim 5, wherein:

each of the plurality of latching posts is semicircular in shape, and each of the plurality of latching grooves is semicircular in shape.

* * * * *